US009777478B1

(12) United States Patent
Hulka et al.

(10) Patent No.: US 9,777,478 B1
(45) Date of Patent: Oct. 3, 2017

(54) DRYWALL SHEET END JOINT

(71) Applicant: USG Interiors, LLC, Chicago, IL (US)

(72) Inventors: Samuel D. Hulka, Mount Prospect, IL (US); Peder J. Gulbrandsen, Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 15/205,102

(22) Filed: Jul. 8, 2016

(51) Int. Cl.

| | |
|---|---|
| ***E04B 9/24*** | (2006.01) |
| ***E04B 9/28*** | (2006.01) |
| ***E04B 1/99*** | (2006.01) |
| ***E04B 1/84*** | (2006.01) |
| ***E04B 9/00*** | (2006.01) |
| ***E04B 9/04*** | (2006.01) |

(52) U.S. Cl.
CPC ..... *E04B 9/28* (2013.01); *E04B 1/8409* (2013.01); *E04B 1/99* (2013.01); *E04B 9/001* (2013.01); *E04B 9/0464* (2013.01)

(58) Field of Classification Search
CPC . E04B 9/28; E04B 1/99; E04B 9/0464; E04B 9/001; E04B 1/8409
See application file for complete search history.

(56) References Cited

U.S. PATENT DOCUMENTS

| | | | | |
|---|---|---|---|---|
| 2,814,080 | A | 11/1957 | Tvorik et al. | |
| 3,675,383 | A | 7/1972 | Paoletti | |
| 5,799,458 | A | 9/1998 | Ferguson | |
| 6,523,314 | B1 * | 2/2003 | LaLonde | E04B 9/005 52/506.07 |
| 7,578,107 | B2 | 8/2009 | Platt | |
| 8,684,134 | B2 | 4/2014 | Dugan et al. | |
| 8,770,345 | B2 | 7/2014 | Dugan et al. | |
| 8,898,986 | B1 | 12/2014 | Underkofler et al. | |
| 8,925,677 | B2 | 1/2015 | Dugan et al. | |
| 2003/0154686 | A1 | 8/2003 | Platt | |
| 2005/0193668 | A1 | 9/2005 | Hamilton | |
| 2007/0186493 | A1 * | 8/2007 | Baig | B28B 11/12 52/144 |
| 2007/0277467 | A1 | 12/2007 | Platt | |
| 2008/0245018 | A1 | 10/2008 | Miller et al. | |
| 2008/0245026 | A1 | 10/2008 | Hamilton | |
| 2010/0257807 | A1 | 10/2010 | Raheel et al. | |
| 2013/0133978 | A1 * | 5/2013 | Borroni | E04B 1/86 181/291 |

* cited by examiner

*Primary Examiner* — Patrick J Maestri
(74) *Attorney, Agent, or Firm* — Pearne & Gordon LLP

(57) ABSTRACT

A suspended ceiling comprising SUSPENDED metal runners in a horizontal plane, the runners each having a horizontal flange having an effective vertical thickness, a plurality of rectangular drywall sheets aligned crosswise to the runners and screwed to the flanges with ends of the drywall sheets forming butt joints midway between adjacent runners, boards overlying butt joints and adjacent flanges, the boards being substantially stiffer than the drywall sheets, whereby the drywall sheet ends are drawn up towards an upper level of the flanges when screwed against the overlying board so that a pseudo taper is formed on the drywall sheet ends.

3 Claims, 2 Drawing Sheets

DRYWALL SHEET END JOINT

BACKGROUND OF THE INVENTION

The invention relates to drywall ceiling construction and, in particular, to a construction in which taped end joints between drywall sheets are easily concealed.

PRIOR ART

Drywall sheets are manufactured as rectangular panels with a standard width of four feet and with a regular series of lengths of 8, 10, 12, 14 and 16 feet or metric industry equivalents. The long edges or margins of the sheets are tapered at their face side. The tapered margins are provided to enable tape and joint compound to be received in a joint above the face plane of the ceiling being constructed. The ends of the sheets are not tapered because of limitations of the production process used to make the sheets. Joints between the ends of drywall sheets, sometimes called butt joints, are difficult to conceal because the thickness of the joint tape intrudes into the plane of the face of the ceiling. The butt joints in ceilings are particularly difficult to conceal, in part, because they are often highlighted by indirect lighting. Frequently, a drywall ceiling is heavily textured to mask the presence of butt joints. Texturing of a ceiling is not practical where a relatively smooth surface is specified and/or where the drywall has acoustical properties derived from a porous face.

U.S. Pat. Nos. 7,578,107 and 8,898,986 illustrate examples of sheet metal strips or bars that can be used to suspend transverse sheet metal drywall grid tees. The strips or bars have regular keyhole-like slots along their length that capture the upper reinforcing bulbs of the tees. Drywall sheets are conventionally attached to the lower flange faces of the suspended grid tees with self-drilling screws.

SUMMARY OF THE INVENTION

The invention provides a grid-based structure for a suspended drywall ceiling that facilitates concealment of drywall butt joints. In the inventive structure, grid runners or tees are suspended in a horizontal plane on parallel regularly spaced centers. Drywall sheets are fastened to lower faces of the grid tees. The drywall sheets are positioned so that their lengths are crosswise to the grid runners and their abutted ends are cantilevered midway between adjacent grid runners. A flat faced rigid bridge member is located between the adjacent grid runners and overlies the abutted ends of the drywall sheets. The bridge member is supported on the top of the flanges of the adjacent runners so that its lower surface is spaced above the plane of the bottom faces of the runner flanges by the effective thickness of the flanges. Typically, the flange is thicker at hems on its longitudinal edges. The drywall sheet ends are screwed to the bridge member.

Because the bridge member lower surface is above the plane of the runner flanges, the ends of the drywall sheets are caused to be locally bent upwardly a precise distance corresponding to the effective thickness of the runner flange.

This bending of the ends of the drywall sheets has the effect of forming a pseudo taper to receive joint tape and joint compound. The pseudo taper is adapted to fully receive the joint tape and joint compound above the plane of the major face areas of the drywall sheets. The taper is limited both vertically and horizontally so that only a narrow band of joint compound is required to flush out the joint.

The invention thus avoids butt joints where the tape and joint compound protrude from the plane of the main face areas of the drywall sheets. The invention is especially useful in acoustical drywall ceilings such as disclosed in U.S. Pat. Nos. 8,684,134, 8,770,345 and 8,925,677. Commonly, a heavy texture coat is used to conceal protruding taped butt joints. This approach is impractical with an acoustical ceiling since such coatings would block sound absorbing apertures in the drywall sheets and reduce or eliminate acoustical properties.

DESCRIPTION OF THE PREFERRED EMBODIMENT

Figure 1:
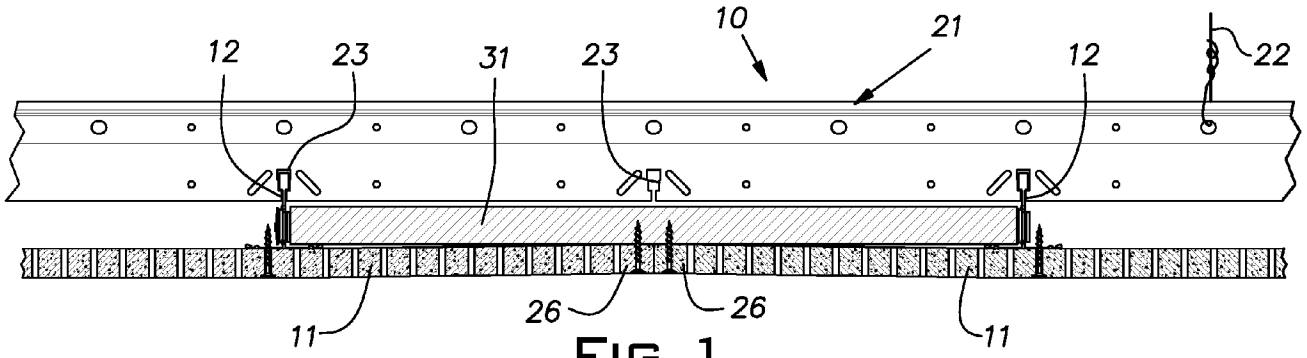
FIG. 1 is a fragmentary cross-sectional view of a butt joint of a suspended drywall ceiling taken in a vertical plane indicated at 1-1 in FIG. 3.

A suspended ceiling 10 includes rectangular drywall sheets or panels 11 attached to grid runners 12. The drywall sheets 11, as is conventional, are gypsum based and are typically 4 foot wide by, 8, 10, 12, 14 or 16 feet long and ⅜, ½ or ⅝ inch thick. Dimensions recited in this disclosure are intended to include industry metric equivalents. Normally, the long edges of the sheets 11 are tapered for receiving joint compound and joint tape when the sheets are abutted along their long edges.

The illustrated grid runners 12 are of the T-style with an upper reinforcing bulb 16, a lower flange 17, and a vertical web 18 between the bulb and flange. The grid runner or tee 12 can be roll formed from a single elongated strip of sheet metal, typically, G40 hot dipped galvanized steel as known in the art.

A comparatively flat ceiling construction is obtained by using sheet metal hanger bars known in the industry and from U.S. Pat. Nos. 7,578,107 and 8,898,986 for example. The bars 21, suspended in a common horizontal plane by wires 22, are mutually spaced in parallel rows on, for example, 4 foot centers in a direction perpendicular to that of the subsequently erected tees 12. The bars 21 are positioned endwise relative to one another so that they present rectangular holes 23 in mutual alignment for capturing the reinforcing bulbs 16 for vertical overhead support of the tees 12.

Figure 3:
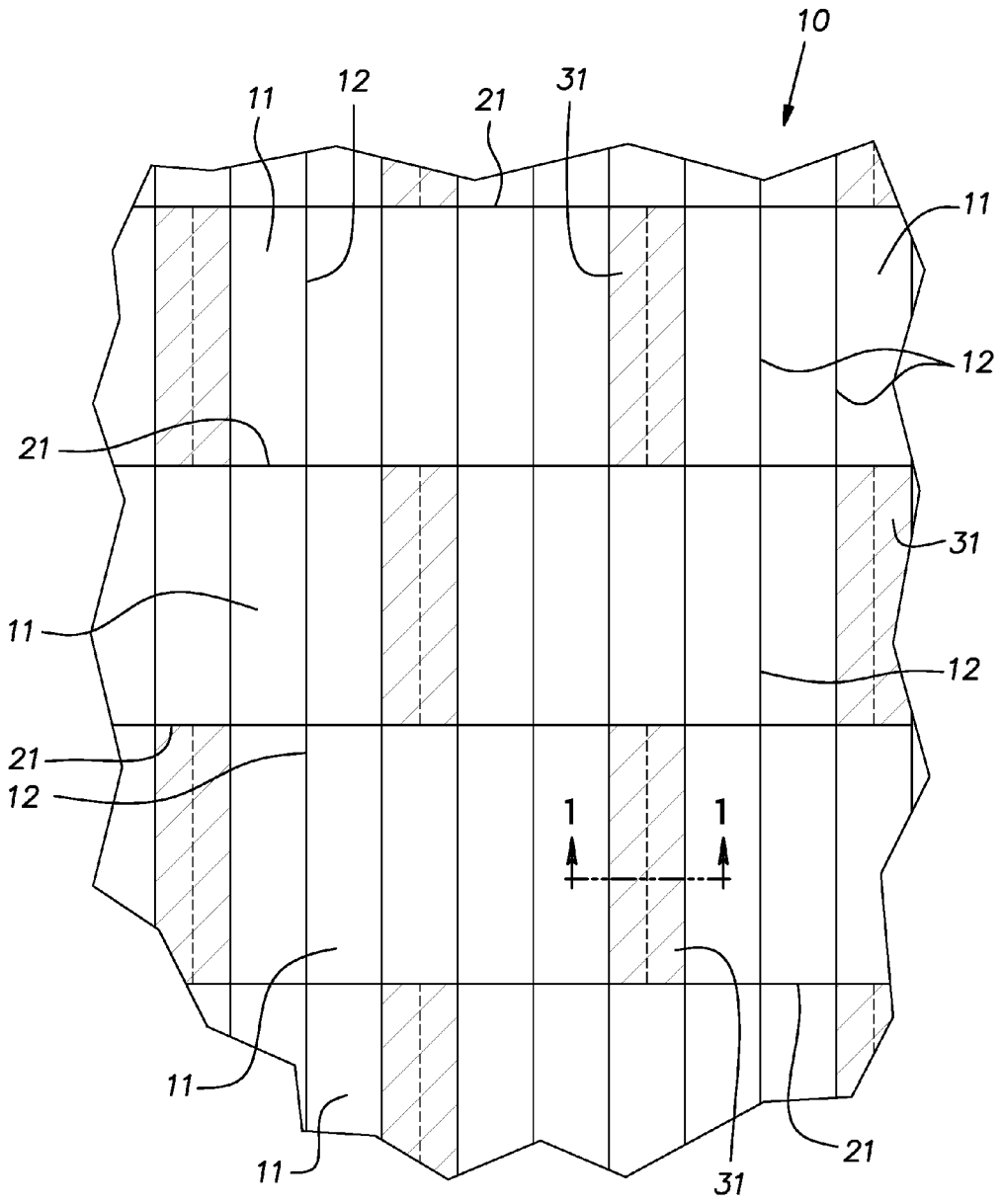
FIG. 3 is a fragmentary schematic plan view of a suspended ceiling embodying the invention.

FIG. 3 schematically illustrates an example of a layout of 4 foot by 8 foot drywall sheets 11 and grid tees 12 on 16 inch centers, the latter being determined by the regular spacing of holes 23 in the support bars or hanger bars 21. As indicated, the sheets 11 are arranged with their lengthwise direction perpendicular or crosswise to the longitudinal direction of the tees 12. The sheets 11 are further arranged so that their ends 26 are cantilevered and abutted at locations spaced midway from adjacent grid tees 12.

Figure 2:
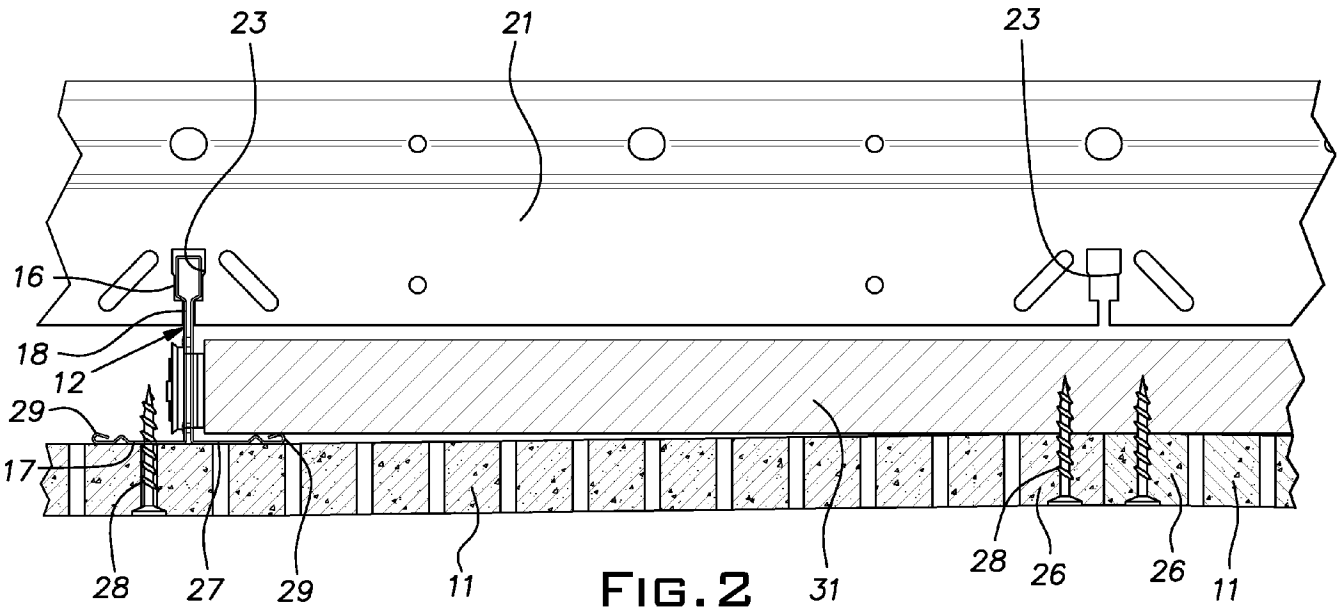
FIG. 2 is a view of the butt joint of FIG. 1 on an enlarged scale.

The sheets 11 are attached to lower faces 27 of the grid tees 12 with self-drilling screws 28 that penetrate both the sheets and the tee flanges as is conventional. Inspection of FIG. 2 shows that longitudinal edges of the grid tee flanges 17 are folded up into hollow hems 29 that increase the flange effective thickness, measured vertically across bottom to top of the flange elements. By way of example, but not limitation, the effective thickness can preferably be between about 0.50 inch to about 0.55 inch.

A bridge element 31 in the form of a flat rectangular rigid board is located in the grid space overlying abutted ends 26 of two drywall sheets 11. The illustrated bridge 31 is a flat board with nominal planar dimensions of 4 foot by 15⅞ inch and with a thickness of ⅝ inch. Preferably, the width dimension is greater than the gap between adjacent flanges 17 so that the board 31, once positioned, cannot readily fall off the flanges 17. The board 31 is substantially more rigid (at least twice as rigid) than conventional drywall sheets. The abutted ends 26 of the sheets 11, preferably after the sheets are first secured to the adjacent tees 12 by screws 28, are drawn up to the bottom surface of the bridge board 31 by suitable screws 28. In this manner, the ends of the drywall sheets 11 are bent upwardly a precise distance that approaches the effective thickness of the tee flanges 17. The effect is to provide a pseudo taper on the drywall sheet ends 26. This pseudo taper on both of the abutting sheet ends 26 forms a space of limited but adequate vertical dimension for completely receiving joint tape and joint compound above the plane of the main non-tapered face areas of the drywall sheets 11. This enables the sheet 11 to be taped with a flatness that makes the butt end joints imperceptible when painted without significant texture. Joint tape is typically about 0.006 inch to 0.009 inch thick and 2 inch wide. The board is sufficiently rigid to draw the drywall ends up when screwed to it so that the pseudo taper 1½ inch in from a butt joint edge is elevated at least 0.009 inch. A suitable board product is ⅝ inch FIBEROCK® Aqua-Tough™ interior panels marketed by United States Gypsum Company.

The disclosed inventive suspension arrangement is particularly suitable for use with acoustical drywall products such as disclosed in the aforementioned U.S. patents. As disclosed in these patents, the drywall sheets are perforated throughout their major areas through both face and rear paper covering and the face covering is, in turn, covered with a non-woven pervious scrim. Ultimately the scrim is painted to conceal the holes while maintaining sufficient porosity to allow air passage and therefore sound transmission into the perforations. The present inventive arrangement enables butt joints of the acoustical drywall sheets to be readily taped and finished without a heavy and/or textured appearance coating to conceal the joints.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A suspended ceiling comprising a grid of parallel regularly spaced roll formed elongated sheet metal runners suspended in a horizontal plane from overhead structure, the runners each having a horizontal flange having an effective vertical thickness, a plurality of rectangular drywall sheets aligned crosswise to the runners and screwed to lower faces of the flanges with ends of the drywall sheets forming butt joints located midway between adjacent runners, flat boards overlying butt joints and the flanges of said adjacent runners, the boards being substantially stiffer than the drywall sheets, whereby the drywall sheet ends are drawn up towards an upper level of the flanges when the drywall sheet ends are screwed against the overlying board so that a pseudo taper is formed on the drywall sheet ends for receiving joint tape and joint compound above a lower face of major central areas of the drywall sheets.

2. A suspended ceiling as set forth in claim 1, wherein the drywall sheets are through perforated across their central areas.

3. A suspended ceiling as set forth in claim 1, wherein the grid runners are suspended in spaced parallel alignment from metal support bars arranged crosswise to the grid runners and gripping the grid runners at reinforcing bulbs adjacent upper portions of the grid runners.

* * * * *